US009508517B2

(12) United States Patent
Breili

(10) Patent No.: US 9,508,517 B2
(45) Date of Patent: Nov. 29, 2016

(54) SUBSEA FUSE

(71) Applicant: Siemens Aktiengesellschaft, München (DE)

(72) Inventor: Rune Breili, Tanem (NO)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/901,103

(22) PCT Filed: Jul. 25, 2014

(86) PCT No.: PCT/EP2014/066045
§ 371 (c)(1),
(2) Date: Dec. 28, 2015

(87) PCT Pub. No.: WO2015/022171
PCT Pub. Date: Feb. 19, 2015

(65) Prior Publication Data

US 2016/0133422 A1 May 12, 2016

(30) Foreign Application Priority Data

Aug. 12, 2013 (EP) ..... 13180069

(51) Int. Cl.
*H01H 85/00* (2006.01)
*H01H 85/175* (2006.01)
(Continued)

(52) U.S. Cl.
CPC ..... *H01H 85/0026* (2013.01); *H01H 85/0021* (2013.01); *H01H 85/0086* (2013.01);
(Continued)

(58) Field of Classification Search
CPC ..... H01H 85/0021; H01H 85/0026; H01H 85/0241; H01H 85/40; H01H 9/02; H01H 85/175; H01H 85/0086; H01H 85/43; H01H 85/06; H01H 2231/044
USPC ..... 337/1, 187, 204
See application file for complete search history.

(56) References Cited

U.S. PATENT DOCUMENTS 1,462,489 A * 7/1923 Grigsby ..... H01H 85/36 337/239
1,562,984 A * 11/1925 Murray ..... H01H 85/0456 337/237
(Continued)

FOREIGN PATENT DOCUMENTS

EP 2492947 A1 8/2012
EP 2495746 A1 9/2012
EP 2565899 A1 3/2013

OTHER PUBLICATIONS

International Search Report PCT/ISA/210 for International Application No. PCT/EP2014/066045 dated Sep. 26, 2014.
(Continued)

*Primary Examiner* — Anatoly Vortman
(74) *Attorney, Agent, or Firm* — Harness, Dickey & Pierce, P.L.C.

(57) ABSTRACT

A subsea fuse for use in a high-pressure environment is provided. The subsea fuse includes a fuse element, a first lid and a second lid, and electrical connections for contacting the fuse element. Furthermore, a hollow elongated element made of a flexible material is provided. The first and second lids and the hollow elongated element form a liquid-tight chamber, which is filled with a liquid. The fuse element is arranged inside the liquid-tight chamber.

28 Claims, 3 Drawing Sheets

(51) Int. Cl.
*H01H 85/06* (2006.01)
*H01H 85/43* (2006.01)
*H01H 85/36* (2006.01)

(52) U.S. Cl.
CPC ..... *H01H85/06* (2013.01); *H01H 85/175* (2013.01); *H01H 85/43* (2013.01); *H01H 85/36* (2013.01); *H01H 2231/044* (2013.01)

(56) References Cited

U.S. PATENT DOCUMENTS 1,829,604 A * 10/1931 Natalis ..... H01H 85/40 337/277
2,247,084 A * 6/1941 Goff ..... H01H 85/044 337/248
2,681,398 A * 6/1954 Kozacka ..... H01H 85/044 174/50.52
2,866,875 A * 12/1958 Swain ..... H01H 85/0456 337/158
3,132,226 A * 5/1964 Bennett ..... H01H 9/102 218/107
3,276,368 A * 10/1966 Tower ..... B63B 21/28 102/255
3,291,926 A * 12/1966 Nelson ..... H01H 9/085 200/302.1
3,450,948 A 6/1969 Gerlach et al.
3,522,570 A * 8/1970 Wanaselja ..... H01H 85/44 337/28
3,604,873 A * 9/1971 Boliver ..... H01H 33/021 218/97
3,662,309 A * 5/1972 Harmon ..... H01H 85/54 337/202
3,681,731 A * 8/1972 Kozacka ..... H01H 85/055 337/166
3,723,930 A * 3/1973 Koch ..... H01H 85/044 337/158
3,848,215 A * 11/1974 Kozacka ..... H01H 85/165 337/186
3,878,314 A * 4/1975 Link ..... G02B 6/4451 174/17 LF
4,012,708 A * 3/1977 Goe, Jr. ..... H01F 27/402 337/205
4,028,656 A * 6/1977 Schmunk ..... H01H 69/02 174/179
4,083,028 A * 4/1978 Haubein ..... H01H 85/46 200/333
4,135,174 A * 1/1979 Biller ..... H01H 85/143 337/186
4,136,339 A * 1/1979 Kuhn ..... H01H 85/32 337/224
4,208,787 A * 6/1980 Luck ..... H01H 69/02 29/623
4,743,996 A * 5/1988 Book ..... H01H 85/44 337/31
D315,894 S * 4/1991 Giannini ..... D13/171
5,103,203 A * 4/1992 Huber ..... H01H 85/157 337/205
5,270,679 A * 12/1993 Gulbrandsen ..... H01H 85/18 29/623
5,977,498 A * 11/1999 Levine ..... H01H 9/04 200/11 R
7,808,362 B2 * 10/2010 Stanek ..... H01H 85/0013 337/186
8,212,646 B2 * 7/2012 Crane ..... H01H 9/44 337/273
8,292,109 B2 * 10/2012 Lauk ..... F16H 57/027 215/307
8,427,807 B2 * 4/2013 Bo ..... H01G 2/10 361/272
9,035,739 B2 * 5/2015 Boe ..... H01H 85/0021 337/186
2008/0212268 A1 * 9/2008 Janisch ..... H05K 5/068 361/724
2009/0045906 A1 * 2/2009 Stanek ..... H01H 85/0013 337/206
2009/0226262 A1 * 9/2009 Karstad ..... B63G 8/08 405/191
2009/0266815 A1 * 10/2009 Lauk ..... F16H 57/027 220/89.1
2013/0286549 A1 * 10/2013 Hazel ..... H02B 7/00 361/624
2014/0055227 A1 2/2014 Boe et al.
2014/0374132 A1 * 12/2014 Boe ..... H01H 85/0013 174/50.51

OTHER PUBLICATIONS

International Preliminary Report on Patentability for International Application No. PCT/EP2014/066045 mailed Nov. 9, 2015.
Extended European Search Report issued in European Patent Application No. 13180069, dated Jan. 31, 2014.
Search Report and Written Opinion issued in International Application No. PCT/EP2014/066045, mailed Oct. 13, 2014.

* cited by examiner

SUBSEA FUSE

PRIORITY STATEMENT

This application is the national phase under 35 U.S.C. §371 of PCT International Application No. PCT/EP2014/066045 which has an International filing date of Jul. 25, 2014, which designated the United States of America and which claims priority to European patent application number EP13180069.0 filed Aug. 12, 2013, the entire contents of which are hereby incorporated herein by reference.

FIELD

An embodiment of the invention generally relates to a subsea fuse for use in a high pressure environment and to a subsea electrical device.

BACKGROUND

Due to the increasing energy demands, offshore oil and gas production is moving into deeper waters. For ensuring an efficient and secure production, processing facilities are being installed at the ocean floor. Such subsea installations can comprise a range of components, including pumps, compressors and the like. A subsea power grid can be provided for operating these components. The power grid may for example comprise a subsea transformer, subsea switchgear and subsea variable speed drives. The components of the subsea installation need to be protected from the surrounding sea water, in which pressures of 300 bars or more can prevail (at installation depths of 3.000 m or more).

To protect subsea equipment from overcurrents or short-circuits, fuses can be installed which interrupt an electrical connection if the current through the fuse becomes too large. A conventional fuse comprises a fuse body and a fuse element. The fuse element is generally a metal strip or wire and is connected between two electrical terminals of the fuse. At currents above the rated current, the fuse element melts, thereby interrupting the electrical circuit. The faulty circuit can thus be isolated, whereby damage to other electric components of the system can be prevented.

For providing a fuse for subsea applications, a conventional fuse can be placed into a pressure resistant canister which is maintained at a pressure of about one atmosphere. The canister needs to be thick walled in order to withstand the high pressures at water depths of up to 3000 m or even more. Sophisticated penetrators capable of bridging such high pressure differences are further required to provide an electrical connection to the fuse through the walls of the canister. This solution of providing a fuse for a subsea application is very cost intensive due to the canister and the penetrators and further requires a considerable amount of space. The canister is also very heavy.

More recently, solutions were proposed in which electric components are placed in pressure compensated canisters. The canisters are filled with a dielectric liquid and a pressure is maintained inside the canister that is almost equal to the surrounding water pressure. Standard fuses are generally incompatible with such environment. The inventors have found that the dielectric liquid changes the properties of a conventional fuse significantly. The fuse will still be capable of breaking a current when triggered, but this will cause an explosion inside the fuse, which can be detrimental to other electric components (e.g. due to a shockwave or shrapnel). Further, the combustion products of the explosion can contaminate the surrounding dielectric liquid severely. This can cause failures in other components exposed to the dielectric liquid. Conventional fuses can thus not be used in a pressurized environment.

A solution to this problem is proposed in the document EP 2495746 A1, which describes a subsea fuse assembly.

SUMMARY

The inventors have discovered that it is desirable to provide a fuse for subsea applications that is compact and comparatively light weight. The fuse should furthermore be capable of being operated in a pressurized environment, in particular a dielectric liquid environment. The inventors have discovered that it would furthermore be beneficial if the fuse can be manufactured at comparatively low cost.

Also, The inventors have discovered that it is desirable to reduce the complexity of known solutions for subsea fuses.

Accordingly, the inventors have discovered that there is a need to provide an improved fuse for subsea applications that mitigates at least some of the drawbacks mentioned above.

The claims describe embodiments of the invention.

An embodiment of the invention provides a subsea fuse adapted to be operated in a high pressure environment. The subsea fuse comprises a fuse element, a first lid and a second lid and electrical connections for contacting the fuse element. The subsea fuse further comprises a hollow elongated element made of flexible material having a first opening and a second opening for said first and second lids, respectively, at opposing ends thereof. The first opening in the hollow elongated element is sealed in a liquid-tight manner by the first lid and the second opening in the hollow elongated element is sealed in a liquid-tight manner by the second lid, such that the first and second lids and the hollow elongated element form a liquid-tight chamber. The liquid-tight chamber is filled with a liquid and the fuse element is arranged inside the liquid-tight chamber. The hollow elongated element is adapted to provide pressure compensation between a pressure inside the liquid-tight chamber and the high pressure environment surrounding the subsea fuse when installed subsea.

It is to be understood that the features mentioned above and those had to be explained below can be used not only in the respective combinations indicated, but also in other combinations or in isolation, without leaving the scope of the present invention.

BRIEF DESCRIPTION OF THE DRAWINGS

The foregoing and other features and advantages of the invention will become further apparent from the following detailed description read in conjunction with the accompanying drawings. In the drawings, like reference numerals refer to like elements.

DETAILED DESCRIPTION OF THE EXAMPLE EMBODIMENTS

Figure 1:
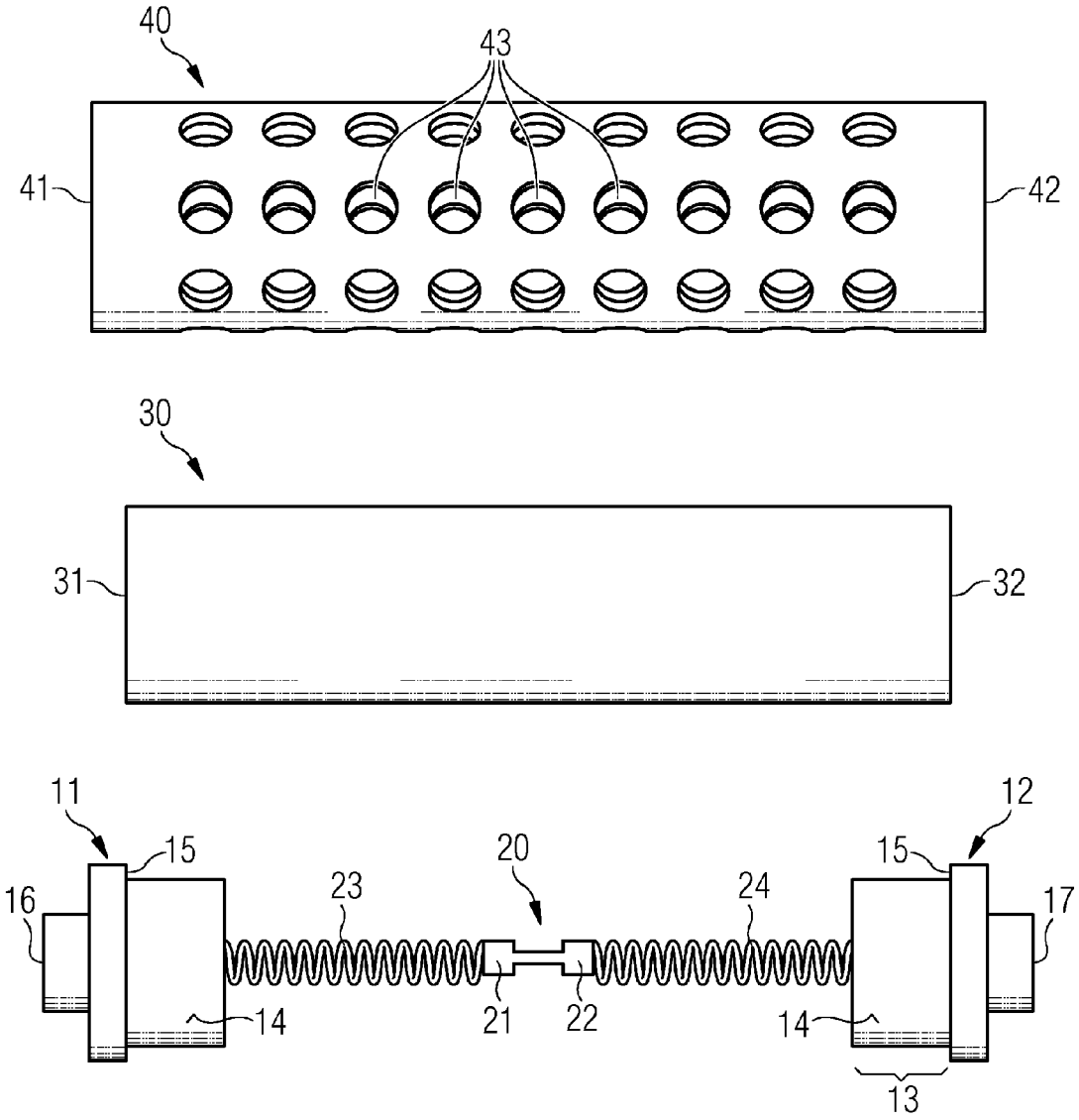
FIG. 1 is a schematic drawing showing components of a subsea fuse according to an embodiment of the invention.

An embodiment of the invention provides a subsea fuse adapted to be operated in a high pressure environment. The subsea fuse comprises a fuse element, a first lid and a second lid and electrical connections for contacting the fuse element. The subsea fuse further comprises a hollow elongated element made of flexible material having a first opening and a second opening for said first and second lids, respectively, at opposing ends thereof. The first opening in the hollow elongated element is sealed in a liquid-tight manner by the first lid and the second opening in the hollow elongated element is sealed in a liquid-tight manner by the second lid, such that the first and second lids and the hollow elongated element form a liquid-tight chamber. The liquid-tight chamber is filled with a liquid and the fuse element is arranged inside the liquid-tight chamber. The hollow elongated element is adapted to provide pressure compensation between a pressure inside the liquid-tight chamber and the high pressure environment surrounding the subsea fuse when installed subsea.

By such configuration, a compact and lightweight subsea fuse may be obtained, which has a reduced complexity. The hollow elongated element can, by way of its flexibility, provide pressure compensation between the inside of the chamber and the outside environment, so that the subsea fuse may for example be deployed inside a pressure compensated enclosure of a subsea device. By balancing the pressure between the inside of the liquid-tight chamber and the high-pressure environment outside the liquid-tight chamber, the differential pressure between inside and outside the liquid-tight chamber can be kept low, and the subsea fuse is thus operable in water depths down to 3000 meters or even in excess of that. Furthermore, the liquid-tight chamber may ensure that if the fuse is triggered, i. e. the fuse element melts, the contamination caused by such melting cannot reach the environment outside the liquid-tight chamber. The contamination can be confined within the liquid-tight chamber. Accordingly, the operation of the remaining components of e.g. a subsea electric device is not compromised by the triggering of the subsea fuse.

In an embodiment, the hollow elongated element provides a flexibility which enables the change of the volume of the liquid-tight chamber in accordance with a pressure difference between the inside pressure (i. e. pressure inside the liquid-tight chamber) and the outside pressure (pressure of the high-pressure environment), so that the inside pressure is adjusted to the outside pressure. The flexibility of the hollow elongated element does effectively reduce the differential pressure across the hollow elongated element, the differential pressure may be close to zero or, by adjusting the filling of the liquid-tight chamber or the flexibility of the hollow elongated element, may be biased in one or the other direction.

In an embodiment, the subsea fuse further comprises a rigid protective sleeve arranged between the first and the second lid and covering the hollow elongated element at least partially. By such sleeve, protection may be provided for the hollow elongated element. Further, the mechanical stability of the subsea fuse may be increased.

In an embodiment, the rigid protective sleeve extends between the first and the second lid and covers the hollow elongated element over its length. Furthermore, the rigid protective sleeve may be provided with one or more openings to enable a passage of liquid from the high pressure environment to the hollow elongated element. The one or more openings may be provided as a perforation of the rigid protective sleeve. In such configuration, the pressure balancing functionality of the hollow elongated element can be maintained, while the mechanical stability of the subsea fuse at the protection of the hollow elongated element can be improved.

The rigid protective sleeve may have a hollow elongated cylindrical shape with openings at opposing ends, and the first and second lids may be engaged with the openings at the opposing ends. For example, the first lid may be in engagement with an opening in a first end of the rigid protective sleeve, and the second lid may be in engagement with an opening in a second end of the rigid protective sleeve, so that the rigid protective sleeve provides mechanical separation between the first and second lids.

The first lid and/or the second lid may be engaged with the rigid protective sleeve by way of an interference fit, a press fit or a snug fit. In other embodiments, the first lid and/or the second lid may be mounted to the rigid protective sleeve via a threaded connection, by an adhesive or by molding or the like. It should be clear that the above mentioned possibilities can be combined, i.e. the first lid and the second lid do not need to be engaged with the rigid protective sleeve in the same way, although in some embodiments, they may use the same type of engagement. In some embodiments, there may be no mechanically tight connection between the rigid protective sleeve and the respective lid, but it may be a rather loose connection capable of being separated without force. In such configuration, the first and second lids may for example be held in place by the internal configuration of the subsea fuse, in particular by way of the electrical connections for contacting the fuse element.

In an embodiment, the rigid protective sleeve is made of a non-conductive material. In embodiments, the rigid protective sleeve may for example be made out of a plastic material, a resin, a polymer, a glass or a ceramic material. Other non-conductive materials are certainly conceivable.

In an embodiment, the first lid and/or the second lid has a cylindrical section and a shoulder, the cylindrical section being arranged inwardly of the shoulder (i.e. in a direction towards the interior of the liquid-tight chamber), wherein the hollow elongated element encompasses the cylindrical face of the cylindrical section and abuts the shoulder. As an example, the inner diameter of the hollow cylindrical element, i.e. the diameter of the respective opening at the opposing ends of the element, may be slightly smaller than the diameter of the cylindrical face of the cylindrical section, so that due to the flexibility of the hollow elongated element, it can be slid over the cylindrical section and fixed thereto by the pressure applied by the resiliency of the flexible material of the hollow elongated element (i.e. by the elastic force caused by stretching the flexible material). Additionally or alternatively, fixation between first lid and/or second lid and the hollow elongated element may be provided by molding the hollow flexible element to the lid, using an adhesive for fixation, using a clamp or a bracket for fixation or the like. The rigid protective sleeve may for example act as a clamp which clamps the end of the hollow elongated element to the respective lid.

In an embodiment, the protective sleeve extends over the shoulder of the respective lid. A compact subsea fuse with reduced complexity can thus be obtained.

In an embodiment, the hollow elongated element is tube-shaped; it may in particular be cylindrically shaped.

The hollow elongated element may be an elastomeric tube or hose.

In an embodiment, the first and second lids are made of a conductive material, in particular of metal. The electrical connections for contacting the fuse element may be provided via the first and second lids. In such configuration, there would be no penetrators required across the respective lid, which further reduces the complexity of the subsea fuse. As an example, one terminal of the fuse element may be connected to the first lid and the other terminal of the fuse element may be connected to the second lid. An electrical connection to the respective lid may for example be provided by soldering.

In an embodiment, the electrical connections comprise a first spring connected between the first lid and a terminal of the fuse element. The first spring may be under tension when the subsea fuse is in an assembled and operable stage. As an example, the first spring may be soldered to the first lid, and it may on its other end be soldered to the terminal of the fuse element. In such configuration, the spring force applied by the first spring to the lid (due to the first spring being pre-tensioned) will apply a force on the terminal of the fuse element towards the lid. If the fuse element melts, the spring will retract and will thus accelerate the extinguishing of an arc forming between the open terminals of the fuse element by pulling one remaining part of the fuse element towards the lid. Further, in a state before the melting of the fuse element, the spring will apply a force on the lid towards the inside of the liquid-tight chamber, e. g. towards the rigid protective sleeve. The mechanical stability of the fuse may thus be improved and the fixation of the lid to the rigid protective sleeve can be supported.

Electrical connections may further comprise a second spring connected between the second lid and a second terminal of the fuse element. Accordingly, the fuse element may be suspended between two springs. The second spring may again be under tension when the subsea fuse is in an assembled and operable state. The tensioned springs may support holding the lids and the rigid protective sleeve together. Furthermore, the tensioned springs may accelerate the extinguishing of an arc when the fuse element melts.

In an embodiment, the liquid-tight chamber is filled with dielectric liquid, in particular with an oil, such as transformer oil or silicon oil.

The hollow elongated element is preferably made of a non-conductive material, in particular a resilient non-conductive material. In particular, it may be made of a plastic material or a polymer material. In an embodiment, the hollow elongated element is made of a material selected from the group comprising or consisting of rubber, nitrile rubber, thermoplastic polyurethanes (TPU), polyvinylchloride (PVC), silicon, butyl rubber or a material comprising polyester filaments. Other types of non-conductive flexible materials are also conceivable.

A further embodiment of the invention provides a subsea electrical device comprising a subsea fuse in any of the above outlined configurations. The subsea electrical device may for example be a subsea transformer, a subsea switchgear, or a subsea variable speed drive.

In an embodiment, the subsea electrical device comprises a power input for receiving electrical power and an electric component. The subsea fuse may be connected between the power input and the electric component. In such configuration, the electric component can be protected against overcurrents by way of the subsea fuse.

In an embodiment, the subsea electrical device comprises a pressure compensated enclosure which is filled with a liquid, in particular a dielectric liquid. The enclosure is configured such that the pressure inside the enclosure is balanced to the ambient pressure when the subsea electrical device is installed subsea, e.g. by way of a pressure compensator. The subsea fuse may be arranged inside the pressure compensated enclosure. The electric component is also arranged inside the pressure compensated enclosure, so both may be located in the same liquid. Accordingly, the liquid inside the pressure compensated enclosure is not contaminated upon melting of the fuse element, since any contamination is confined within the hollow elongated element of the subsea fuse. Since both the space inside the enclosure and the liquid-tight chamber inside the subsea fuse are pressure compensated, the differential pressures across the enclosure and the housing of the subsea fuse (i.e. the sleeve, the hollow elongated element and the lids) is low, so that both the enclosure and the housing can be kept compact and comparatively lightweight. Effectively, a two stage pressure compensation system is provided by way of the pressure compensated enclosure of the subsea electrical device and the hollow elongated element of the subsea fuse.

In the following, embodiments of the present invention will be described in detail with reference to the accompanying drawings. It is to be understood that the following description of the embodiments is given only for the purpose of illustration and is not to be taken in a limiting sense.

It should further be noted that the drawings are to be regarded as being schematic representations only, and elements in the drawings are not necessarily to scale with each other. Rather, the representation of the various elements is chosen such that their function and general purpose become apparent to a person skilled in the art.

FIG. 1 schematically illustrates components of a subsea fuse in accordance with an embodiment of the invention. The subsea fuse comprises a first lid 11 and a second lid 12. At the first and second lids 11, 12, electrical terminals 16 and 17, respectively, are provided for electrically contacting the subsea fuse.

The subsea fuse comprises the fuse element 20 having a first terminal 21 and a second terminal 22. The subsea fuse further comprises electrical connections between the first lid 11 and the first terminal 21, and between the second lid 12 and the second terminal 22. In the embodiment of FIG. 1, these electrical connections are provided by a first spring 23 and a second spring 24. First spring 23 can for example be soldered to the first lid 11 at one of its ends and to the first terminal 21 at the other of its ends. Similarly, the second spring 24 can be soldered to the second lid 12 at one of its ends and to the second terminal 22 at the other of its ends. In other embodiments, the electric connections for contacting the fuse element 20 may be provided differently, for example in form of an electric conductor, such as a strip, a conductor section, a cable or the like, or the terminals of the fuse element 20 may be directly connected to the respective lids 11 or 12.

The lids 11 and 12 are made of metal in the embodiment of FIG. 1 and are thus conducting. In particular, the lids 11 and 12 provide an electrical connection between the outer terminals 16 and 17 and the respective electric connections for contacting the fuse element 20, i.e. the springs 23 and 24, respectively, in the example of FIG. 1. Consequently, there is no requirement of providing any penetration of a conductor through the lids 11 and 12. A simple configuration of the subsea fuse can thus be achieved.

The subsea fuse further comprises a hollow elongated element 30. The hollow elongated element 30 is made of a flexible material, so that a differential pressure across the wall of the hollow elongated element 30 causes the hollow elongated element 30 to bend or flex, i.e. to change its internal volume, thus providing pressure equalization as will be explained in more detail hereinafter.

In the example of FIG. 1, the hollow elongated element 30 is provided by an elastomeric hose or tube. As can be seen, the first and second lids 11 and 12 each comprise a cylindrical section 13 which extends in a direction towards the fuse element 20, i. e. towards the interior of the subsea fuse. The cylindrical section 13 has a cylindrical face 14, on which the hollow elongated element 30 can be seated. The hollow elongated element 30 has a first opening 31 and a second opening 32 at opposing ends thereof, which can be slid over the cylindrical section 13 of the respective lid 11 and 12. Furthermore, lids 11 and 12 comprise a shoulder 15. This can be provided as a stop for the hollow elongated element 30, which can, when mounted, abut the shoulder 15 of the respective lid 11 or 12.

The subsea fuse further comprises an optional rigid protective sleeve 40, which is provided to protect the hollow elongated element 30, for example from mechanical damage. In the example of FIG. 1, the rigid protective sleeve 40 is provided by a perforated cylinder having a first opening 41 and a second opening 42 at opposing ends. It is perforated by way of a plurality of openings 43. The first and second openings 41 and 42 are sized so that the rigid protective sleeve 40 can extend over the whole length of the hollow elongated element 30 and can extend over the shoulders 15 of the first and second lids 11 and 12. Accordingly, the hollow elongated element 30 can be protected by the sleeve 40 over its whole length. By way of the openings 43, i. e. the perforation of the rigid protective sleeve 40, it is ensured that an ambient medium, for example dielectric liquid provided in a chamber of a subsea electric device, can reach the outer surface of the hollow elongated element 30, thus enabling pressure equalization between the inside of the hollow elongated element 30 and the ambient medium (via the flexibility and thus deformation of the hollow elongated element 30).

Figure 2:
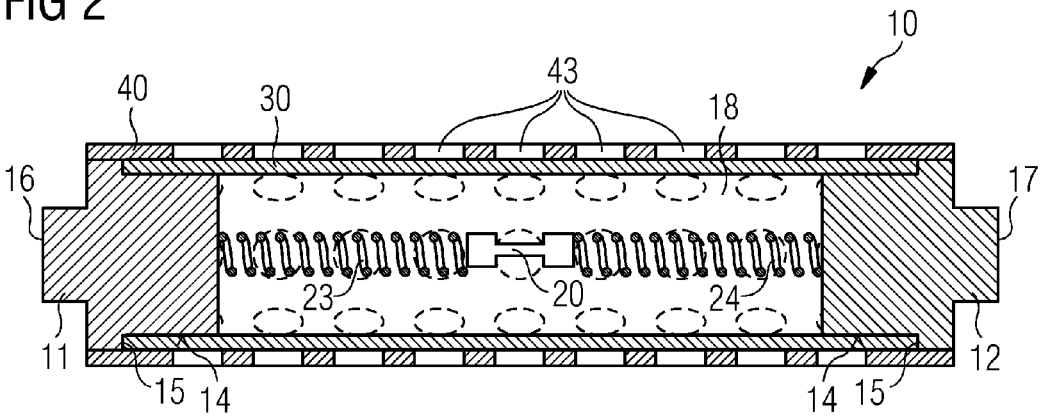
FIG. 2 is a schematic drawing showing a sectional view of a subsea fuse in accordance with an embodiment of the invention which was assembled from the components shown in FIG. 1.

The subsea fuse described with respect to FIG. 1 is shown in an assembled state in FIG. 2 and designated by the reference numeral 10. Accordingly, the explanations given about are equally applicable to the subsea fuse 10 shown in FIG. 2. As can be seen, in the assembled state, the hollow elongated element 30 is seated on the cylindrical faces 14 of the first and second lids 11 and 12 and abuts the shoulders 15. An adhesive may be used additionally or alternatively to fix the hollow elongated element 30 on the cylindrical faces 14.

A liquid-tight seal is provided between the lids 11 and 12 and the hollow elongated element 30. This may for example be achieved by the hollow elongated element 30 applying a compressive force to the cylindrical face 14 of the respective lid 11, 12, by using an adhesive between the hollow elongated element 30 and the respective lid 11, 12 as mentioned above, by using a clamp, a bracket or the like to provide a sealing between the hollow elongated element 30 and the respective lid 11, or by other corresponding sealing devices. Accordingly, if the fuse element 20 melts, resulting in a contamination of the liquid inside the liquid-tight chamber 18, the contamination is confined to within the liquid-tight chamber 18 and cannot pollute the ambient medium surrounding the subsea fuse 10.

Different possibilities exist for mounting the rigid protective sleeve 40 to the respective lids 11 and 12. As an example, lids 11 and 12 may be screwed into a threaded portion at the openings 41, 42 of the rigid protective sleeve 40, an adhesive may be used between the rigid protective sleeve 40 and the lids 11 and 12, or an engagement may be provided by an interference fit or a snug fit or the like. The rigid protective sleeve can be used as a clamp which clamps the hollow elongated element to the lids 11, 12, in particular to the cylindrical faces 14 of the lids.

In the assembled state as shown in FIG. 1, the springs 23 and 24 are tensioned, i. e. they are from an equilibrium position extended so that they apply a contractive force which pulls the respective terminal towards which they are attached towards the lid to which they are attached. Accordingly, if a fuse element 20 melts, the first terminal 21 is pulled towards the first lid 11 via the first spring 23 and the second terminal 22 is pulled towards the second lid 12 via the second spring 24. An arc which is generated between the terminals 21 and 22 upon melting of the fuse element 20 will thus extinguish faster. Furthermore, in the assembled stage shown in FIG. 2, the springs 23 and 24 apply a force to the lids 11 and 12 and pull these lids towards each other. This pulling force may support the mounting of the first and second lids 11, 12 to the rigid protective sleeve 40.

As can be seen in FIG. 2, the hollow elongated element 30 is exposed to an ambient medium surrounding the subsea fuse 10 through the holes 43 provided in the rigid protective sleeve 40. If the pressure in the ambient medium increases, it is transmitted through the flexible hollow elongated element 30 to the inside of the liquid-tight chamber 18 formed by the element 30 and the first and second lids 11 and 12. The liquid-tight chamber 18 is filled with a liquid, preferably a dielectric liquid such as an oil, for example a transformer oil or a silicon oil or the like. Due to the incompressibility of such liquid, a slight deformation of the flexible hollow elongated element 30 already increases the pressure inside the liquid-tight chamber 18, so that the pressure in chamber 18 is balanced to the pressure of the ambient medium. In such configuration, a lightweight fuse can be achieved, which can be deployed in pressures in excess of 300 bars, without requiring a thick-walled enclosure and without any substantial deformation of the fuse housing.

Furthermore, volume changes of the liquid filling the liquid-tight chamber 18, which may be caused by temperature and/or pressure changes, will be compensated by the flexibility of the hollow elongated element 30, thus leading to a balanced pressure inside chamber 18 and in the ambient medium surrounding the subsea fuse 10.

Figure 3:
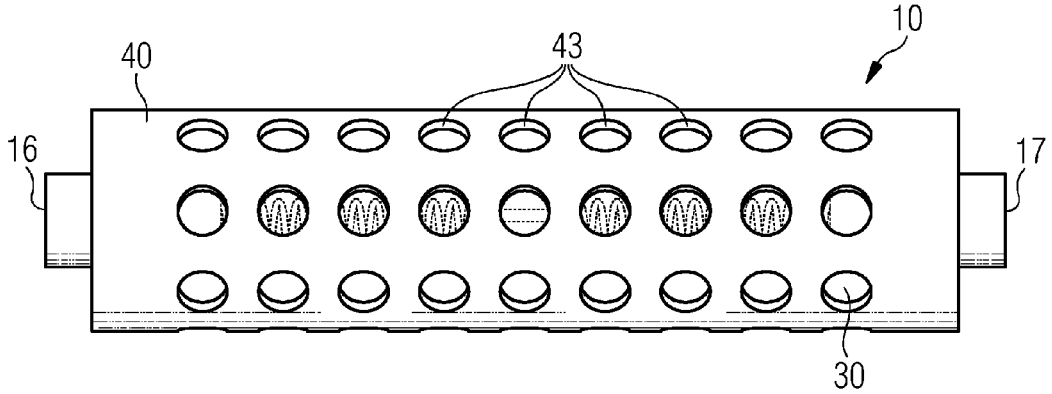
FIG. 3 is a schematic drawing showing a perspective view of the subsea fuse of FIGS. 1 and 2.

FIG. 3 shows a prospective view of the subsea fuse 10. The perforation 43 of the rigid protective sleeve 40 is illustrated. The rigid protective sleeve 40 provides stiffness to the subsea fuse 10 and protects the elastomeric hose constituting the hollow elongated element 30. Openings for allowing the ambient medium to reach the hollow elongated element 30 which are different from the openings 43 may of course be provided, for example slits in axial or circumferential direction, fewer or more openings, smaller or larger openings, combinations thereof and the like.

Also, it should be clear that the shape of the subsea fuse 10 may be different. It does not need to be a cylindrical, other shapes are also conceivable, such as a rectangular hollow elongated element 30 and rigid protective sleeve 40. Also, configurations are conceivable in which more than one fuse element 20 is provided. The hollow elongated element 30 may for example have end faces with several openings, each of which can be sealed by a lid. The rigid protective sleeve 40 may in such configuration have additional side walls for closing the openings 41, 42 and for supporting the lids on each side of the subsea fuse.

Figure 4:
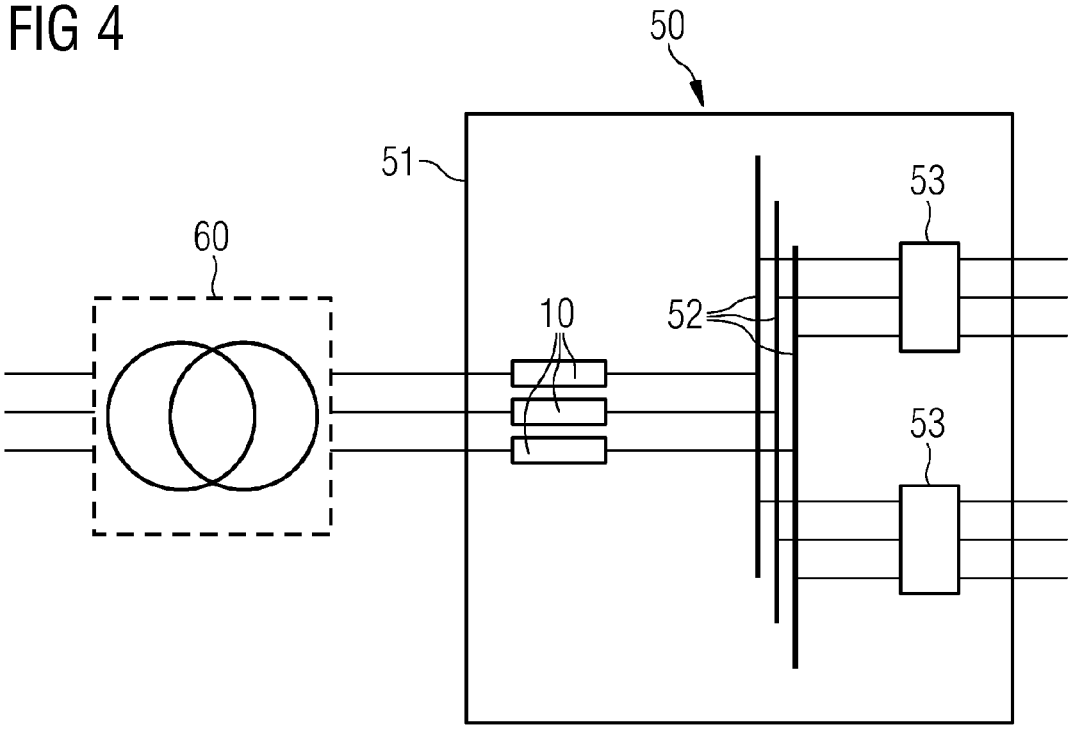
FIG. 4 is a schematic drawing showing a block diagram of a subsea electrical device according to an embodiment of the invention, the device incorporating a subsea fuse.

FIG. 4 is a schematic block diagram showing a subsea electrical device 50 comprising one or more subsea fuses 10. The subsea fuses 10 can have a configuration as outlined further above, so the explanations given above are equally applicable. In the example of FIG. 4, the subsea electrical device 50 is a subsea switchgear comprising a bus 52 (e.g. bus bars) and switches 53. In the exemplary embodiment, a three-phase system is schematically shown comprising three electrical connections to a subsea transformer 60. The three subsea fuses 10 are provided for protecting the subsea transformer 60 against overload, for example upon occurrence of a fault in the subsea switchgear 50, or in subsea equipment coupled thereto. Subsea transformer 60 may receive electric power for example via an umbilical from a topside installation or via a subsea cable from an onshore site (not shown).

The subsea switchgear 50 comprises a pressure compensated enclosure 51, which can be provided with a pressure compensator for equalizing the pressure in the subsea area environment surrounding the subsea switchgear 50 when installed at the ocean floor, and the pressure inside the enclosure 51. Enclosure 51 is filled with a dielectric liquid. Accordingly, the pressure in the seawater surrounding subsea switchgear 50 is transmitted via the pressure compensator (not shown) and the dielectric liquid to the subsea fuses 10. The hollow elongated element 30 of the subsea fuses 10 allows a pressure equalization between the pressure inside the enclosure 51 and the liquid-tight chamber 18 of the subsea fuses 10. Accordingly, a low differential pressure can be achieved, so that the housing of the subsea fuses 10 does not collapse even though only thin walls are provided. Furthermore, upon melting of the fuse element 20, the dielectric liquid inside the enclosure 51 is not contaminated since the contamination (e.g. carbon residues and gases which can develop) is confined within the liquid-tight chamber 18 of the subsea fuses 10.

The configuration of the subsea fuse 10 does allow a compact and lightweight design requiring only a limited number of elements. This together with the reduced complexity of the subsea fuse results in significant cost savings. Furthermore, the subsea fuse 10 can be employed in high-pressure environments in excess of 300 bars, while at the same time it ensures that the environment outside the subsea fuse does not get contaminated when the fuse element 20 melts.

While specific embodiments are disclosed herein, various changes and modifications can be made without departing from the scope of the invention. The present embodiments are to be considered in all respects as illustrative and non-restrictive, and all changes coming within the meaning and equivalency range of the appended claims are intended to be embraced therein.

The invention claimed is:

1. A subsea fuse for use in a high pressure environment, comprising a fuse element;

a first lid and a second lid, each including an electrically conductive material;

electrical connections for contacting the fuse element; and a hollow elongated element made of a flexible material and including a first opening and a second opening for said first and second lids, respectively, at opposing ends thereof, the first opening in the hollow elongated element being sealed in a liquid-tight manner by the first lid and the second opening in the hollow elongated element being sealed in a liquid-tight manner by the second lid, such that the first and second lids and the hollow elongated element form a liquid-tight chamber, wherein the liquid-tight chamber is filled with a liquid and the fuse element is arranged inside the liquid-tight chamber, wherein the hollow elongated element provides pressure compensation between a pressure inside the liquid-tight chamber and the high pressure environment surrounding the subsea fuse when installed subsea, and wherein the electrical connections for contacting the fuse element are provided via the first and second lids, one terminal of the fuse element being electrically connected to the first lid and the other terminal of the fuse element being electrically connected to the second lid.

2. The subsea fuse of claim 1, further comprising:

a rigid protective sleeve arranged between the first and the second lid and covering the hollow elongated element at least partially.

3. The subsea fuse of claim 2, wherein the rigid protective sleeve extends between the first and the second lid and covers the hollow elongated element over its length, and wherein the rigid protective sleeve is provided with one or more openings to enable a passage of liquid from the high pressure environment to the hollow elongated element.

4. The subsea fuse of claim 2, wherein the rigid protective sleeve includes a hollow elongated cylindrical shape with openings at opposing ends, and wherein the first and second lids are engaged with said openings at said ends.

5. The subsea fuse of claim 2, wherein at least one of the first lid and the second lid is engaged with the rigid protective sleeve via an interference fit, press fit, or snug fit or are mounted thereto by a threaded connection, by an adhesive or by moulding.

6. The subsea fuse of claim 2, wherein the rigid protective sleeve is made of a non-conductive material.

7. The subsea fuse of claim 2, wherein at least one of first lid and the second lid includes an cylindrical section and a shoulder, the cylindrical section being arranged inwardly of the shoulder, and wherein the hollow elongated element encompasses a cylindrical face of the cylindrical section and abuts the shoulder.

8. The subsea fuse of claim 7, wherein the protective sleeve extends over the shoulder.

9. The subsea fuse of claim 1, wherein the hollow elongated element is tube-shaped.

10. The subsea fuse of claim 1, wherein the hollow elongated element is an elastomeric tube or hose.

11. The subsea fuse of claim 1, wherein the electrical connections comprise a first spring connected between the first lid and a terminal of the fuse element, the first spring being under tension when the subsea fuse is in an assembled and operable state.

12. The subsea fuse of claim 11, wherein the electrical connections comprise a second spring connected between the second lid and a second terminal of the fuse element, the second spring being under tension when the subsea fuse is in an assembled and operable state.

13. The subsea fuse of claim 1, wherein the hollow elongated element is made of a resilient non-conductive material.

14. The subsea fuse according of claim 1, wherein the hollow elongated element is made of a material selected from the group comprising rubber, nitrile rubber, thermoplastic polyurethanes (TPU), polyvinyl chloride (PVC), silicone, butyl rubber or a material comprising polyester filaments.

15. A subsea electrical device, comprising the subsea fuse of claim 1.

16. The subsea fuse of claim 3, wherein the rigid protective sleeve includes a hollow elongated cylindrical shape with openings at opposing ends, and wherein the first and second lids are engaged with said openings at said ends.

17. The subsea fuse of claim 3, wherein at least one of the first lid and the second lid is engaged with the rigid protective sleeve via an interference fit, press fit, or snug fit or are mounted thereto by a threaded connection, by an adhesive or by moulding.

18. The subsea fuse of claim 3, wherein the rigid protective sleeve is made of a non-conductive material.

19. The subsea fuse of claim 1, wherein at least one of first lid and the second lid includes an cylindrical section and a shoulder, the cylindrical section being arranged inwardly of the shoulder, and wherein the hollow elongated element encompasses a cylindrical face of the cylindrical section and abuts the shoulder.

20. The subsea fuse of claim 9, wherein the hollow elongated element is cylindrically shaped.

21. The subsea fuse of claim 13, wherein the hollow elongated element is made of a plastic material or of a polymer material.

22. The subsea electrical device of claim 15, wherein the subsea electrical device is a subsea transformer or a subsea switchgear.

23. A subsea electrical device, comprising the subsea fuse of claim 2.

24. A subsea electrical device, comprising the subsea fuse of claim 3.

25. A subsea electrical device, comprising the subsea fuse of claim 11.

26. The subsea electrical device of claim 23, wherein the subsea electrical device is a subsea transformer or a subsea switchgear.

27. The subsea electrical device of claim 24, wherein the subsea electrical device is a subsea transformer or a subsea switchgear.

28. The subsea electrical device of claim 25, wherein the subsea electrical device is a subsea transformer or a subsea switchgear.

* * * * *